United States Patent [19]

Feldkamp

[11] Patent Number: 4,884,487

[45] Date of Patent: Dec. 5, 1989

[54] SHOULDER PAD FOR STRING INSTRUMENTS OF THE VIOLIN AND VIOLA TYPE

[76] Inventor: Valerie K. Feldkamp, 916 Stone, Louisville, Ky. 40217

[21] Appl. No.: 293,625

[22] Filed: Jan. 5, 1989

[51] Int. Cl.[4] ..... G10D 3/18

[52] U.S. Cl. ..... 84/280; 84/278

[58] Field of Search ..... 84/278, 280

[56] References Cited

U.S. PATENT DOCUMENTS

| | | | |
|---|---|---|---|
| 1,786,478 | 12/1930 | Connell | 84/280 |
| 2,216,052 | 9/1940 | Spetseris | 84/280 |
| 2,478,530 | 8/1949 | Hall | 84/280 |
| 2,524,526 | 10/1950 | Hines | 84/280 |

FOREIGN PATENT DOCUMENTS

| | | | |
|---|---|---|---|
| 120468 | 5/1901 | Fed. Rep. of Germany | 84/280 |

*Primary Examiner*—Lawrence R. Franklin

*Attorney, Agent, or Firm*—Maurice L. Miller, Jr.

[57] ABSTRACT

A chin or shoulder pad for use with violins and violas is disclosed which includes a soft, flexible, resilient body having gradually rounded sides and a flexible, resilient neck attached to or near one rounded corner of the body and extending diagonally therefrom. The body mounts flush against the underside surface of the resonance body of the musical instrument on a lower end portion thereof below the C-shaped bouts such that the neck extends around and over the chin rest turnbuckle or screw assembly. A pair of straps connect opposite corner portions of a distal end of the neck to corresponding corners at the base of the body to form a pair of loops which extend around lower inside corners of the resonance box bouts. The straps connecting the pad to both bouts tends to inhibit sliding movement of the body and neck caused by rubbing movement of a musician thereagainst. The strap which extends to and around the bout corner located on the side of the resonance box opposite the side containing the chin rest is capable of supporting a decorative ornament which is readily viewable by an observer when the instrument is being played. In the preferred embodiment, the body of the pad is generally rectangular in shape and has rounded sides and the neck is connected to one body corner and extends diagonally outward and upward therefrom.

10 Claims, 2 Drawing Sheets

SHOULDER PAD FOR STRING INSTRUMENTS OF THE VIOLIN AND VIOLA TYPE

BACKGROUND OF THE INVENTION

This invention relates generally to chest and shoulder rests for stringed musical instruments of the violin and viola type.

Generally speaking, a variety of such pads have been known and used in the prior art to protect the chest, or shoulder in particular, the clavical of a violinist from bruises and abrasions caused by rubbing movement of the instrument when in use. Among such prior art pads are those disclosed in U.S. Pat. No. 2,524,526 issued to W. J. Hines on Oct. 3, 1950; U.S. Pat. No. 3,827,329 issued to D. M. Annessa on Aug. 6, 1974; U.S. Pat. No. 1,156,925 issued to B. Poehland on Oct. 19, 1915; and Netherlands Pat. No. 64,911 published July 15, 1949. All of the subject devices are characterized by padding disposed on a lower corner portion of the underside surface of a violin resonance box beneath the area of the upper surface where the chin meets the instrument. The pads shown in the subject Annessa, Poehland, Netherlands and Hines patents connect by means of looped straps to a lower corner portion of the C-shaped constriction or bout located on the same side of the resonance box of the instrument upon which the chin of the player rests. The first two reference pads are connected between the bout corner and the tail piece anchor button located on the centerline of the instrument at the lower end of the resonance box. The pad disclosed in the Hines patent connects between an inside bout corner and the chin rest of the instrument and covers the latter element.

One difficulty that has been encountered with such prior art devices, except the Annessa device, is their tendency to slide laterally upon the underside surface of the resonance box with rubbing movement of the musician thereagainst, sometimes necessitating occasional and other times frequent readjustment. The device of the Annessa patent overcomes this problem through the use of an elongated, snake-like rigid are connected between the anchor button and one bout corner, the length of the arm extending nearly the entire intervening distance therebetween.

By means of my invention, this and other difficulties encountered in the use of prior art violin chest and shoulder pads is substantially reduced if not altogether eliminated.

SUMMARY OF THE INVENTION

It is an object of my invention to provide a chest or shoulder pad for a musical instrument of the violin and viola type.

It is a further object of my invention to provide a chest and shoulder pad for a violin or viola which is secured to lower corner portions of both bouts of the instrument to inhibit lateral sliding movement of the pad thereon during use.

It is yet another object of my invention to provide a chest and shoulder pad for a violin or viola which includes means for protecting the user from abrasion by a chin rest screw assembly of the instrument.

It is also an object of my invention to provide a chest or shoulder pad for a violin or viola which includes a pair of straps for securing the pad to the resonance box of the instrument without touching the strings thereof.

It is an additional object of my invention to provide a chest or shoulder pad for a violin or viola which contains a pair of straps for securing the pad to the bouts of the instrument, one of which straps supports a decorative ornament which is readily viewable by an observer when the instrument is played.

Briefly, in accordance with my invention, there is provided a chest or shoulder pad for a musical instrument such as a violin, viola or the like of the type which includes a resonance box containing bouts on opposite sides thereof, a top surface, a bottom surface, a rib interposed between the top and bottom surfaces, a chin rest disposed over a lower corner portion of the top surface, a screw assembly connecting the chin rest to a corresponding lower corner portion of the rib and string accessories including a tail piece and a tail piece anchor button. The pad of my invention includes a flexible, resilient body portion adapted to fit the contour of the bottom surface on a lower portion of the resonance box below the bouts. The pad also includes a flexible, resilient neck portion being adapted to extend outwardly and upwardly from the body portion to cover at least a portion of the screw assembly. The pad further includes a pair of flexible straps connectable between opposite corner portions of a distal end of the neck portion and corresponding corner portions of an upper end of the body portion. The straps are adapted to extend around lower corner portions of the bouts to inhibit sliding movement of the pad on the resonance box resulting from rubbing movement of a player of the instrument against the pad.

These and other objects, features and advantages of my invention will become apparent to those skilled in the art from the following detailed description and attached drawings upon which, by way of example, only a preferred embodiment of the invention is described and illustrated.

DESCRIPTION OF THE PREFERRED EMBODIMENT

Figure 1:
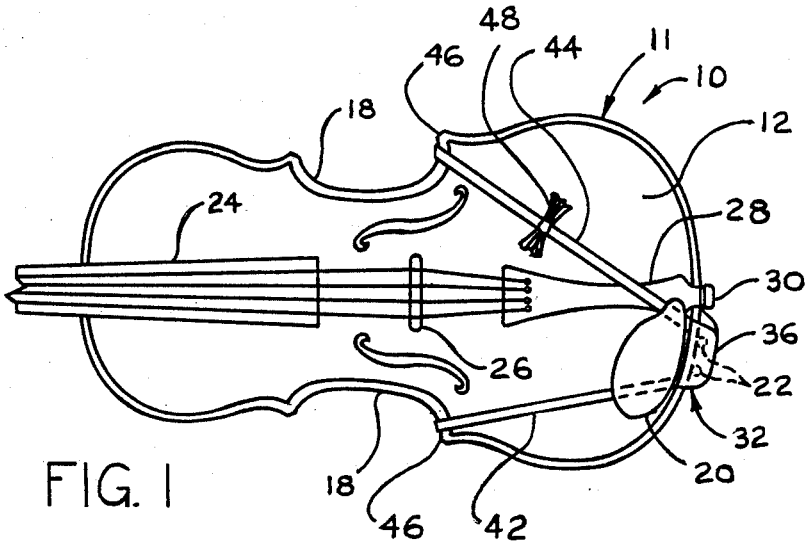
FIGS. 1–3 show a top plan view, a side elevation view and a bottom plan view, respectively, of a conventional violin and an attached chest or shoulder pad, thus illustrating one preferred embodiment of my invention.
Figure 2:
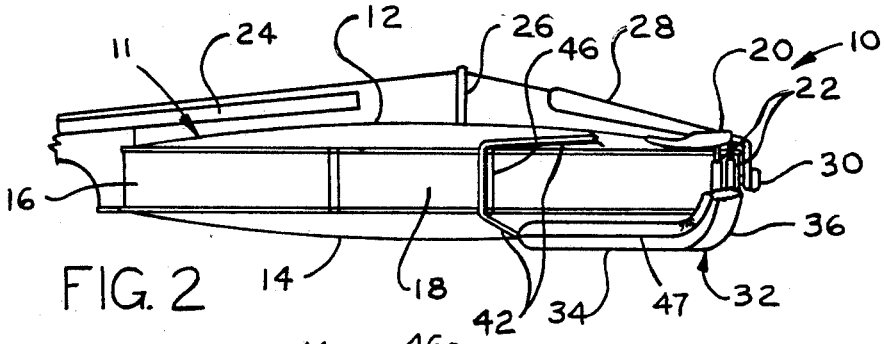
Figure 3:
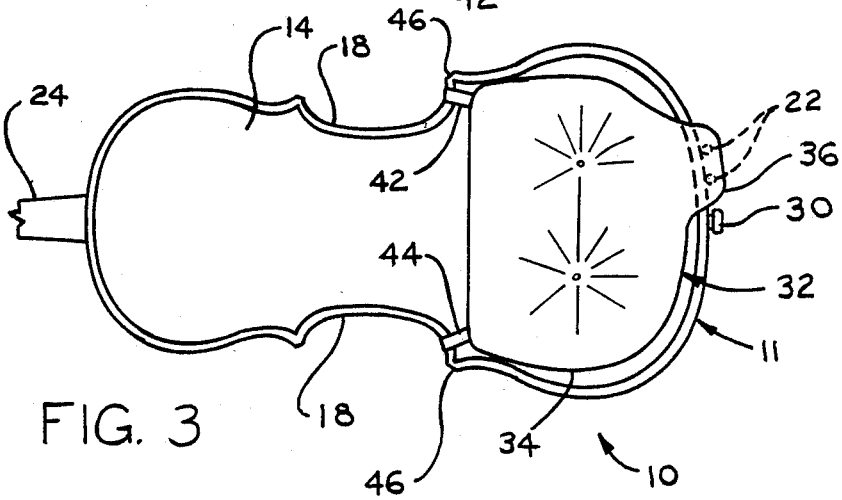

Referring now to the drawing figures and, in particular to FIGS. 1–3, there is shown a conventional violin 10 of the usual, well known type having a resonance box 11 characterized by a top surface 12, a bottom surface 14, a rib 16 interposed between the top and bottom surfaces 12 and 14, and C-shaped constrictions or bouts 18 on opposite sides thereof. A chin rest 20 is positioned over a lower corner portion of the top surface 12 and is connected by means of a conventional turnbuckle or screw assembly 22 to a corresponding lower corner portion of the rib 16. The violin 10 contains the usual string accessories including a finger board 24, bridge 26, tail piece 28 and tail piece anchor button 30.

Now in accordance with the preferred embodiment of my invention and referring also to FIGS. 4–8, there is shown a chest or shoulder pad 32 for mounting on the violin 10 which includes a generally rectangular shaped, flexible, resilient body portion 34 and a flexible resilient neck portion 36 extending diagonally away from one corner of the body portion 34. The pad 32 contains a similar shaped flexible resilient mass 38 (See FIGS. 5–6) of material such as polyurethane foam or other suitable material and a flexible cover 40 made of cloth, leather, vinyl plastic or other suitable material. A pair of flexible straps 42 and 44 connect between opposite corner portions of a distal end 45 of the neck portion 36 and corresponding end corner portions of the body portion 34.

In use, the body portion 34 is mounted against the bottom surface 14 on a lower end portion of the resonance box 11 below the bouts 18 so that the neck portion 36 extends around and over the screw assembly 22 for protective purposes. Once the pad 32 is in proper position, the straps 42 and 44 are looped around the lower corners 46 of the resonance box 11 just inside the bouts 18 to secure the pad 32 in place. I prefer to make the straps 42 and 44 out of any suitable, highly stretchable, resilient elastic material, in which case end portions thereof may be sewn into a side seam 47 in the cover 40. When made of elastic material and sewn in this manner, the straps 42 and 44 should be in a slightly stretched state such that the neck portion 36 is pulled in an upward or perpendicular direction relative to the body portion 34 when the pad 32 lies at rest as on a table top when not in use. There should, however, remain sufficient additional stretch capability in the straps 42 and 44 to allow the strap loops to be stretched around the lower corners of the resonance box 11 and around the lower corners 46 of the bouts 18 to attach the pad 32 in place and to permit its subsequent removal.

In the alternative, the straps 42 and 44 may be made of relatively non-stretchable material such as leather or vinyl plastic, in which case the straps should be permanently connected only at one end of the pad 32. The free ends of the straps 42 and 44 and the corresponding ends of the pad 32 to which they are to be removably connected should then contain suitable fasteners such as snaps, for example, to allow the straps 42 and 44 to be formed into secure, tight fitting loops around the lower inside corners 46 of the bouts 18 to hold the pad 32 securely upon the violin 10 as shown.

The shape of the body portion 34 and the position of the neck portion 36 at one corner thereof assures that the strap 44 will cross over a lower end portion of the tail piece 28 of the violin 10 near the anchor button 30 so as not to touch and dampen the violin strings. Moreover, because of the shape of the pad of my invention, it is possible to use two straps to secure the pad 32 to both bouts 18 to inhibit it from sliding on the lower surface 14 of the resonance box 11 which might otherwise occur with rubbing movement of the player's body thereagainst where only one strap is used to secure the pad to a single one of the bouts. Moreover, because the pad 32 uses a strap 44 which crosses a lower corner portion of the resonance box on the side opposite the chin rest 20, the strap 44 can be used to support a decorative ornament which will be readily viewable when the instrument is played such as a cloth flower, bouquet or bow for women or an ornamental bow tie for men. An ornamental bow tie 48 sewn on the strap 44 is shown in FIG. 1 and illustrates one of the many decorative ornaments that can be employed to conform to the circumstances in which the violin 10 and pad 32 is used such as, for example, a formal recital.

Figure 5:
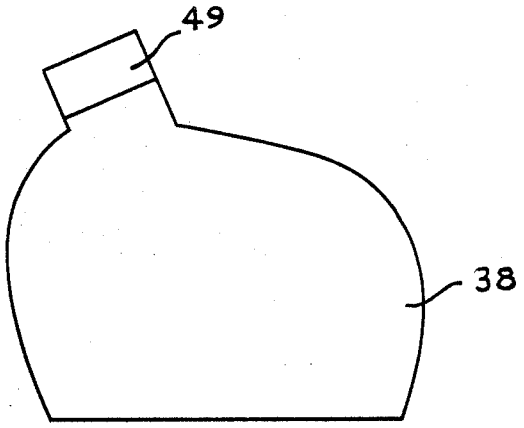
FIGS. 5–6 show a plan view and a side elevation view, respectively, of a foam mass used in the pad of FIGS. 1–3.
Figure 4:
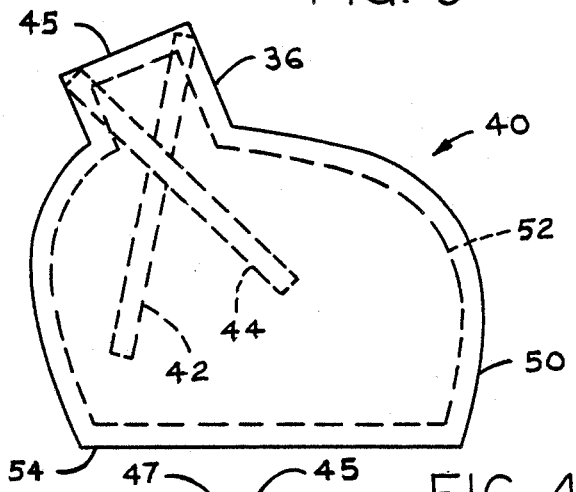
FIG. 4 shows a plan view of a piece of cut cloth with straps partially attached as used to form a cover for the pad of FIGS. 1–3.
Figure 6:
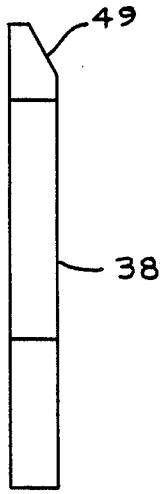
Figure 7:
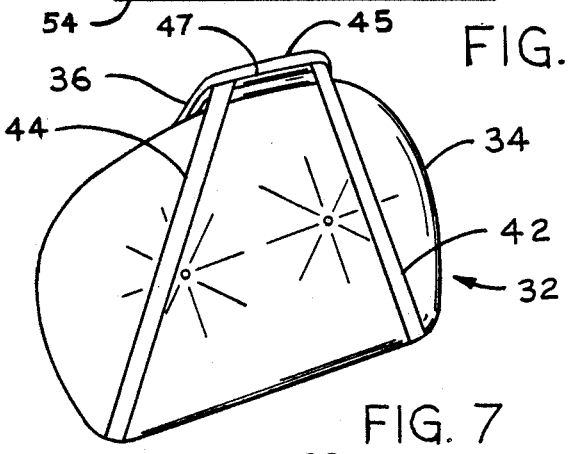
FIGS. 7–8 shows a top plan view and a side elevation view, respectively, of the pad of FIGS. 1–3.
Figure 8:
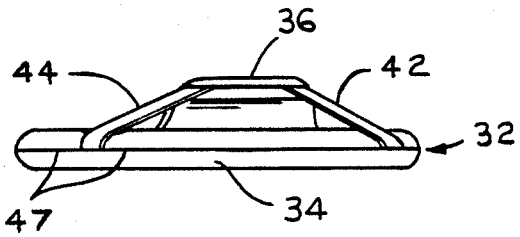

To make the pad 32 of the present example, I use scissors to cut a sheet of polyurethane foam to form the resilient mass 38 as shown in FIGS. 5–6. As shown best in FIG. 6, I recommend tapering the thickness of that portion of the foam mass 38 disposed in the neck portion 36 as at 49 so as not to bulge in an unsightly manner around the screw assembly 22 when the finished pad 32 is installed. A pair of cloth pieces of the same geometric shape as the mass 38 is then cut, one of which is shown in FIG. 4 as at 50. The cloth pieces 50 are identical and slightly larger in size than the mass 38 so as to overlap the edges of the latter for sewing together to form the side seam 47. A dashed line 52 illustrates the edge of the mass 38 around and within the border of the larger cloth pieces 50 although the mass 38 is not inserted until after the pieces 50 are cut and placed one above the other with their right or printed sides opposing one another, the straps 42 and 44 are disposed between the two pieces 50 and sewn on their upper ends as viewed in FIG. 4 to the corners of the neck portion 36, the pieces 50 are sewn together around their common borders except along the base 54, which is left unsewn at this time, and the resulting assembly is pulled inside out so that the straps 42 and 44 lie outside and extend away from the cloth pieces 50 and the printed or right sides of the cover is then exposed. At this point, the mass 38 is inserted into the opening left in the cloth pieces 50 along the base 54, after which the free ends of the straps 42 and 44, assuming they are of the elastic type, are inserted into end corners of the base 54 and the base 54 is sewn shut along its entire length.

Although the present invention has been described with respect to specific details of a certain preferred embodiment thereof, such details should not be understood to limit the scope and coverage of this patent otherwise than as specifically set forth in the following claims.

I claim:

1. A chest or shoulder pad for a musical instrument such as a violin, viola or the like of the type which includes a resonance box containing bouts on opposite sides thereof, a top surface, a bottom surface, a rib interposed between said top and bottom surfaces, a chin rest disposed over a lower end corner portion of said top surface, a screw assembly connecting said chin rest to a corresponding lower corner portion of said rib, and string accessories including a tail piece and a tail piece anchor button, said pad comprising a flexible, resilient body portion adapted to fit the contour of said bottom surface on a lower end portion of said resonance box below said bouts, a flexible, resilient neck portion attached to a lower corner portion of said body portion, said neck portion being adapted to extend outwardly and upwardly from said body portion to cover at least a portion of said screw assembly, and a pair of flexible straps connectable between opposite corner portions of a distal end of said neck portion and corresponding corner portions of an upper end of said body portion, said straps being adapted to extend around lower corner portions of said bouts to inhibit sliding movement of said pad on said resonance box resulting from rubbing movement of a player of said instrument against said pad.

2. The pad of claim 1 wherein said body portion is generally rectangular in shape.

3. The pad of claim 1 or 2 wherein said body portion contains rounded sides.

4. The pad of claim 1 wherein said straps are elastic so as to be stretchable lengthwise and resilient to permit placement of said body portion in position under said chin rest followed by drawing said straps around and over lower end corners of said bouts for placement of said straps in lower corner portions of said bouts.

5. The pad of claim 1 wherein said neck portion extends diagonally away from said body portion.

6. The pad of claim 1 wherein said body and neck portions comprise an integral piece of polyurethane foam, and a cover enclosing said foam selected from the group consisting of cloth, leather and plastic.

7. The pad of claim 6 wherein said foam piece comprises a body portion and a neck portion, said neck portion containing a tapered thickness along at least a portion of its length.

8. The pad of claim 1 wherein one of said straps is adapted to cross over a lower end portion of said tail piece so as to avoid contact with the strings of said instrument.

9. The pad of claim 8 comprising a decorative ornament affixed to one of said straps so as to lie over said upper surface in a lower corner portion of said resonance box opposite the lower corner which contains said chin rest when said one strap is looped around a lower corner portion of one of said bouts.

10. The pad of claim 1 wherein said body portion covers a major portion of the surface area of said bottom surface on a lower end portion of said resonance box below said bouts.

* * * * *